US009099039B2

(12) United States Patent
Kim

(10) Patent No.: US 9,099,039 B2
(45) Date of Patent: Aug. 4, 2015

(54) ORGANIC ELECTRO LUMINESCENCE DISPLAY DEVICE

(71) Applicant: Min Cheol Kim, Yongin (KR)

(72) Inventor: Min Cheol Kim, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 307 days.

(21) Appl. No.: 13/712,063

(22) Filed: Dec. 12, 2012

(65) Prior Publication Data

US 2013/0201088 A1 Aug. 8, 2013

(30) Foreign Application Priority Data

Feb. 2, 2012 (KR) ..... 10-2012-0010942

(51) Int. Cl.
*G09G 3/30* (2006.01)
*G09G 3/32* (2006.01)

(52) U.S. Cl.
CPC ..... *G09G 3/3233* (2013.01); *G09G 2300/0426* (2013.01); *G09G 2310/0281* (2013.01)

(58) Field of Classification Search
CPC ..... G09G 3/3208; G09G 3/3233; G09G 2310/0281; G09G 2300/0426
See application file for complete search history.

(56) References Cited

U.S. PATENT DOCUMENTS

| | | | | |
|---|---|---|---|---|
| 6,066,916 | A * | 5/2000 | Osada et al. | 313/505 |
| 7,573,469 | B2 | 8/2009 | Yamazaki et al. | |
| 2003/0063080 | A1 * | 4/2003 | Takahashi et al. | 345/211 |
| 2007/0018918 | A1 * | 1/2007 | Chung | 345/76 |
| 2008/0186265 | A1 * | 8/2008 | Lee | 345/82 |
| 2008/0246909 | A1 * | 10/2008 | Jung | 349/149 |

FOREIGN PATENT DOCUMENTS

| | | | |
|---|---|---|---|
| GB | 2322958 | A | 9/1998 |
| KR | 10-0236333 | B1 | 12/1999 |
| KR | 10 2007-0019413 | A | 2/2007 |

* cited by examiner

*Primary Examiner* — Lixi C Simpson
(74) *Attorney, Agent, or Firm* — Lee & Morse, P.C.

(57) ABSTRACT

An organic electro luminescence display device includes a display panel including a plurality of pixels arranged at intersections of m columns and n rows, a data driver unit configured to generate data signals and to provide the data signals to the pixels, and a gate driver unit configured to generate a first luminescence control signal, a second luminescence control signal, and scan signals, wherein the scan signals are sequentially provided to the pixels by a row unit, the first luminescence control signal is provided to the pixels via the left-most side of the pixels of the display panel, and the second luminescence control signal is provided to the pixels via the right-most side of the pixels of the display panel.

21 Claims, 3 Drawing Sheets

ORGANIC ELECTRO LUMINESCENCE DISPLAY DEVICE

CROSS-REFERENCE TO RELATED APPLICATIONS

A claim for priority under 35 U.S.C §119 is made to Korean Patent Application No. 10-2012-0010942 filed Feb. 2, 2012, the entirety of which is incorporated by reference herein.

BACKGROUND

The inventive concepts described herein relate to an organic electro luminescence display device, and more particularly, to an organic electro luminance display device capable of reducing a dead space.

An organic electro luminescence display device may have excellent brightness and viewing angle characteristics. Further, the organic electro luminescence display device may not require a separate light source, unlike a liquid crystal display device. For this reason, the organic electro luminescence display device may be in the spotlight as a next-generation flat display device. The organic electro luminescence display device may use a light emitting diode, which emits a light corresponding to the amount of driving current flowing into an anode electrode.

A typical organic electro luminescence display device may include a display panel, which has a plurality of pixels arranged in a plurality of rows and a plurality of columns, a gate driving unit, a source driving unit, and a timing controller. Each of the pixels may include sub-pixels (red, green, and blue pixels).

The gate driving unit may sequentially generate a scan signal under the control of the timing controller to provide the scan signal to pixels by the row.

The source driving unit may generate a data voltage (hereinafter, referred to as a data signal) corresponding to RGB data under the control of the timing controller to provide the data signal to pixels by the column.

The pixels may be arranged at intersections of a plurality of scan lines arranged in a row direction, a plurality of data lines arranged in a column direction, and a plurality of luminescence control lines arranged in parallel with the plurality of scan lines. The pixels may be supplied with scan signals via the plurality of scan lines, data signals via the plurality of data lines, and luminescence control signals via the plurality of luminescence control signals. Sub-pixels of each pixel may have the same pixel circuit structure, and may emit red, green, and blue lights corresponding to currents applied via organic luminescence elements. Thus, the pixels may display a specific color by a combination of lights from red, green, and blue pixels.

SUMMARY

One aspect of embodiments of the inventive concept is directed to provide an organic electro luminescence display device comprising a display panel including a plurality of pixels arranged at intersections of m columns and n rows; a data driver unit configured to generate data signals and to provide the data signals to the pixels; and a gate driver unit configured to generate a first luminescence control signal, a second luminescence control signal, and scan signals. The scan signals are sequentially provided to the pixels by a row unit, the first luminescence control signal is provided to the pixels via the left-most side of the pixels of the display panel, and the second luminescence control signal is provided to the pixels via the right-most side of the pixels of the display panel.

In example embodiments, the display panel further comprises scan lines arranged in a column direction; first connection lines arranged in a row direction perpendicular to the scan lines and connected to pixels arranged at corresponding rows; data lines arranged in a column direction parallel with the scan lines and connected to pixels arranged at corresponding columns; a first luminescence control line arranged at the left-most side of the pixels of the display panel in a column direction; a second luminescence control line arranged at the right-most side of the pixels of the display panel in a column direction; and second connection lines arranged in a row direction perpendicular to the first and second luminescence control lines and connected to pixels arranged at corresponding rows, wherein the scan lines are connected to the first connection lines, respectively, and each of the second connection lines is connected to the first and second luminescence control lines.

In example embodiments, the scan signals are sequentially provided to pixels arranged at corresponding rows via the first connection lines connected with the scan lines, the data signals are provided to the pixels via the data lines, and the first and second luminescence control lines are simultaneously provided to pixels arranged at rows via the second connection lines connected with the first and second luminescence control lines.

In example embodiments, the display panel further comprises scan lines arranged in a column direction; first connection lines arranged in a row direction perpendicular to the scan lines and connected to pixels arranged at corresponding rows; data lines arranged in a column direction parallel with the scan lines and connected to pixels arranged at corresponding columns; a first luminescence control line arranged at the left-most side of the pixels of the display panel in a column direction; a second luminescence control line arranged at the right-most side of the pixels of the display panel in a column direction; second connection lines arranged in a row direction perpendicular to the first and second luminescence control lines and connected to pixels arranged at corresponding rows, first switching circuits arranged at the left-most side of pixels of the display panel and switching the first luminescence control line and the second connection lines; and second switching circuits arranged at the right-most side of pixels of the display panel and switching the second luminescence control line and the second connection lines, wherein on and off states of the first and second switching circuits are controlled by the scan signals sequentially provided via the first connection lines.

In example embodiments, each of the scan signals is an active low-level signal and the first and second switching circuits are sequentially turned on by the low-level scan signals that are sequentially provided.

In example embodiments, the scan signals are sequentially provided to pixels arranged at corresponding rows via the first connection lines connected with the scan lines, the data signals are provided to the pixels via the data lines, and the first and second luminescence control lines are sequentially provided to pixels arranged at rows via the second connection lines sequentially connected with the first and second luminescence control lines by a row unit.

BRIEF DESCRIPTION OF THE DRAWINGS

The above and other objects and features will become apparent from the following description with reference to the following figures, wherein like reference numerals refer to like parts throughout the various figures unless otherwise specified, in which.

DETAILED DESCRIPTION

Figure 1:
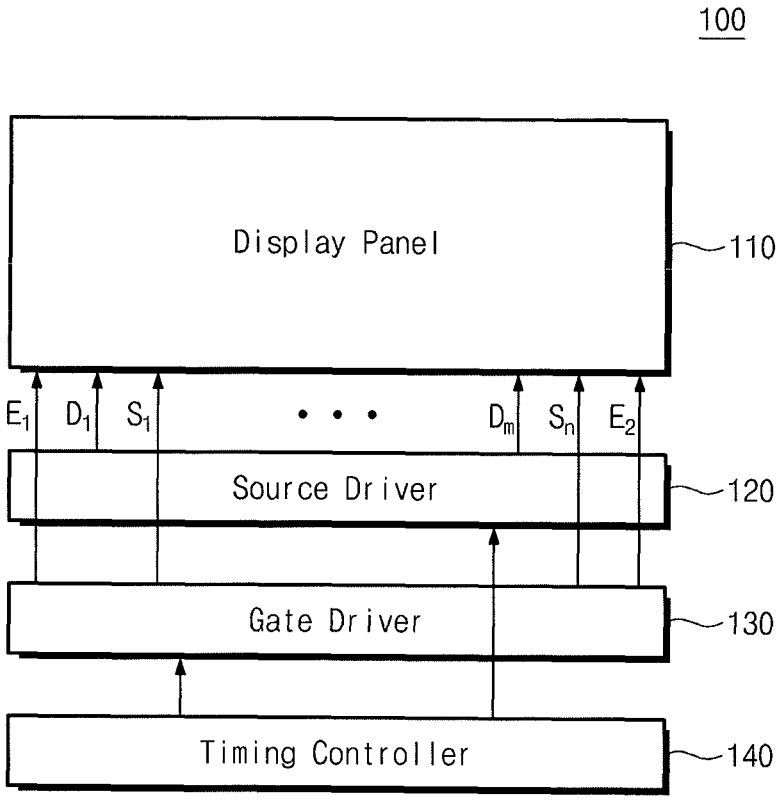
FIG. 1 is a block diagram schematically illustrating an organic electro luminescence display device according to an embodiment of the inventive concept.

The inventive concept is described more fully hereinafter with reference to the accompanying drawings, in which embodiments of the inventive concept are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the size and relative sizes of layers and regions may be exaggerated for clarity. Like numbers refer to like elements throughout.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Hereinafter, example embodiments will be explained in detail with reference to the accompanying drawings.

FIG. 1 is a block diagram schematically illustrating an organic electro luminescence display device according to an embodiment of the inventive concept.

Referring to FIG. 1, an organic electro luminescence display device 100 may include a display panel 110, a source driver unit 120, a gate driver unit 130, and a timing controller 140. The source driver unit 120 and the gate driver unit 130 may be disposed at one side of the display panel 110. For example, in FIG. 1, the source driver unit 120 and the gate driver unit 130 may be disposed at a lower side of the display panel 110.

The display panel 110 may include a plurality of pixels arranged at intersections of M columns and N rows (each of M and N being an integer of 1 or more). This will be more fully described with reference to FIGS. 3 and 4.

The gate driver unit 130 may generate scan signals in response to at least one control signal (e.g., a power supply voltage and a clock signal) provided from the timing controller 140. The scan signals may be sequentially provided to pixels by the row. Scan lines $S_1$ to $S_n$ may be connected to pixels arranged at corresponding rows, respectively. Thus, the scan signals may be sequentially provided to corresponding scan lines $S_1$ to $S_n$ by the row. The scan lines $S_1$ to $S_n$ and the pixels will be more fully described with reference to FIGS. 3 and 4.

The source driver unit 120 may generate data voltages, i.e., data signals, in response to a control signal from the timing controller 140 to provide the data signals to pixels via data lines $D_1$ to $D_m$. The data lines $D_1$ to $D_m$ may be connected to pixels arranged at corresponding columns. Thus, the data signals may be provided to pixels via corresponding data lines $D_1$ to $D_m$. The data lines $D_1$ to $D_m$ and the pixels will be more fully described with reference to FIGS. 3 and 4.

In addition to the scan signals, the gate driver unit 130 may generate a first luminescence control signal and a second luminescence control signal in response to a control signal from the timing controller 140. The first luminescence control signal may be provided to pixels via a left-most side of the display panel 110, e.g., via pixels arranged in the left-most side of the display panel 110, and the second luminescence control signal may be provided to pixels via a right-most side of the display panel 110, e.g., via pixels arranged in the right-most side of the display panel 110.

A first luminescence control line $E_1$ may be disposed at the left-most side of pixels of the display panel 110, and a second luminescence control line $E_2$ may be disposed at the right-most side of pixels of the display panel 110. Thus, the first luminescence control signal may be provided to pixels via the first luminescence control line $E_1$ disposed at the left-most side of pixels of the display panel 110, and the second luminescence control signal may be provided to pixels via the second luminescence control line $E_2$ disposed at the right-most side of pixels of the display panel 110.

The first luminescence control line $E_1$ and the second luminescence control line $E_2$ may be connected to pixels arranged in all rows. In this case, a sequential scan signal and data signals may be provided to pixels, and the first luminescence control line $E_1$ and the second luminescence control line $E_2$ may be connected to pixels arranged at rows at the same time. An interconnection between the first and second luminescence control lines $E_1$ and $E_2$ and pixels and providing, e.g., simultaneously, the first and second luminescence control signals to pixels arranged in rows will be described in more detail below with reference to FIG. 3.

In example embodiments, the first and second luminescence control lines $E_1$ and $E_2$ may be sequentially connected to pixels arranged in all rows via switching circuits. In this case, scan signals, the first luminescence control signal, and the second luminescence control signal may be sequentially provided to pixels arranged in each row, and data signals may be provided to pixels. An interconnection among scan lines, first luminescence control lines $E_1$, and second luminescence control lines $E_2$ for sequentially providing scan signals, first luminescence control signals, and second luminescence control signals to pixels arranged at respective rows will be described in more detail with reference to FIG. 4.

Each of the pixels in the display panel 110 may display an image in response to a scan signal and a luminescence control signal from the gate driver unit 130 and a data signal from the source driver unit 120.

According to example embodiments, the gate driver unit 130 may generate two luminescence control signals for pixels arranged in rows, without including a shift register circuit for generating the luminescence control signal. Therefore, the gate driver unit 130 may have a smaller size than a conventional gate driver unit, i.e., a gate driver unit with a shift register circuit. Further, as the source driver unit 120 and the gate driver unit 130 according to example embodiments may have smaller sizes, both the source driver unit 120 and the gate driver unit 130 may be disposed at, e.g., fit at, a same side, e.g., at a lower side, of the display panel 110, thereby reducing dead spaces in, e.g., in the left, right, and upper sides of the organic electro luminescence display device 100.

In contrast, the conventional gate driving unit may include a shift register circuit that generates a sequential luminescence control signal. Thus, the gate driving unit may sequentially generate a luminescence control signal under the control of a timing controller to provide the luminescence control signal to pixels by the row. The conventional gate driving unit may have a large size due to the shift register, thereby requiring positioning of the gate driving unit and source driver unit in different regions of the display panel, which in turn, may increase a total dead space and overall size of the display panel.

Figure 2:
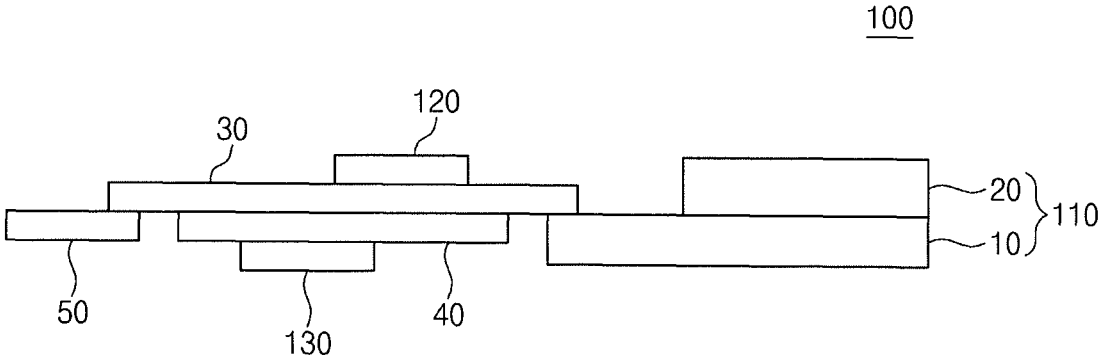
FIG. 2 is a cross-sectional view of the organic electro luminescence display device in FIG. 1.

FIG. 2 is a cross-sectional view of the organic electro luminescence display device 100. Referring to FIG. 2, the organic electro luminescence display device 100 may include a first film 30, a second film 40 attached at a lower part of the first film 30, and a driver printed circuit board 50. The display panel 110 may include a first substrate 10 including a plurality of pixels and a second substrate 20 sealing the plurality of pixels with the first substrate 10. Although not shown in FIG. 2, each of the pixels may be formed of organic electro luminescence elements. For example, the organic electro luminescence elements may be formed on the first substrate 10.

The source driver unit 120 may be attached at an upper part of the first film 30, and the gate driver unit 130 may be attached at a lower part of the second film 40. One end of the first film 30 may be attached at one end of the first substrate 10 of the display panel 110, and the other end of the first film 30 may be attached at one end of the driver printed circuit board 50.

The data lines $D_1$ to $D_m$ of the source driver unit 120 may be connected to pixels arranged in corresponding columns in the display panel 110 via the first film 30. The scan lines $S_1$ to $S_n$ of the gate driver unit 130 may pass through, e.g., corresponding via holes in, the first film 30 and via the second film 40 to be connected to pixels arranged in rows in the display panel 110.

The first and second luminescence control lines $E_1$ and $E_2$ of the gate driver unit 130 may pass through corresponding via holes of the first film 30 via the second film 40. The first and second luminescence control lines $E_1$ and $E_2$ passing through the corresponding via holes of the first film 30 may be connected to pixels via the first film 30. As described above, the first and second luminescence control lines $E_1$ and $E_2$ may be connected to pixels arranged in all rows or may be sequentially connected to pixels arranged in all rows via switching circuits. As described previously, both the source driver unit 120 and the gate driver unit 130 may be disposed at one side, e.g., at a same lower part, of the display panel 110.

Figure 3:
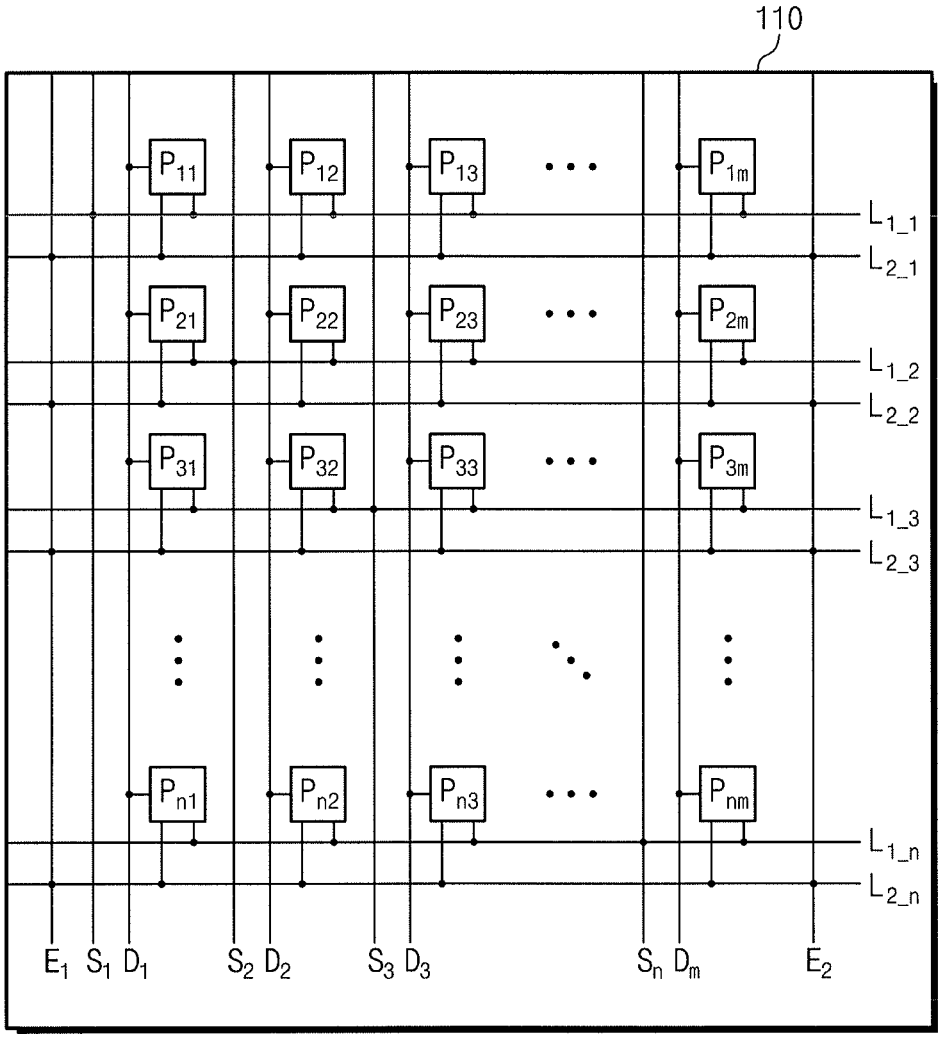
FIG. 3 is a block diagram schematically illustrating a display panel according to an embodiment of the inventive concept.

FIG. 3 is a block diagram schematically illustrating a display panel according to an embodiment of the inventive concept. Referring to FIG. 3, the display panel 110 according to an embodiment of the inventive concept may include a plurality of pixels $P_{11}$ to $P_{nm}$ arranged at intersections of m columns and n rows.

The scan lines $S_1$ to $S_n$ may be arranged along a column direction, and first connection lines $L_{1_1}$ to $L_{1_n}$ may be arranged along a row direction perpendicular to the scan lines $S_1$ to $S_n$. The first connection lines $L_{1_1}$ to $L_{1_n}$ may be connected to corresponding scan lines $S_1$ to $S_n$, e.g., first connection line $L_{1_1}$ may be connected to scan line $S_1$, first connection line $L_{1_2}$ may be connected to scan lines $S_2$, etc. The first connection lines $L_{1_1}$ to $L_{1_n}$ may be connected to pixels $P_{11}$ to $P_{nm}$ arranged at corresponding rows, e.g., first connection line $L_{1_1}$ may be connected to pixels $P_{11}$ to $P_{1m}$ in a first row, first connection line $L_{2_1}$ may be connected to pixels $P_{21}$ to $P_{2m}$ in a second row, etc. Thus, scan signals may be sequentially provided to the pixels $P_{11}$ to $P_{nm}$, arranged at corresponding rows, via the first connection lines $L_{1_1}$ to $L_{1_n}$ connected to the scan lines $S_1$ to $S_n$.

For example, a first scan signal may be provided, e.g., simultaneously, to pixels $P_{11}$ to $P_{1m}$ in a first row via a first connection line $L_{1_1}$ connected to a first scan line $S_1$. Likewise, the remaining scan signals may be sequentially provided to pixels by the row, e.g., a scan signal may be provided to one row of pixels at a time. Since a scan signal is provided to pixels $P_{11}$ to $P_{nm}$ by the row, the number of scan lines may be n (n being an integer of 1 or more), and the number of first connection lines may be n. In other words, the number of scan lines and the number of first connection lines may equal a number of rows of pixels.

The data lines $D_1$ to $D_m$ may be arranged along the column direction to be parallel to the scan lines $S_1$ to $S_n$, and may be connected to pixels arranged at corresponding columns, e.g., each data line may be connected to a plurality of pixels within a same column. Thus, data signals may be provided to the pixels $P_{11}$ to $P_{nm}$ via the data lines $D_1$ to $D_m$.

The first luminescence control line $E_1$ may be disposed at the left-most side of the pixels $P_{11}$ to $P_{nm}$ of the display panel 110, and the second luminescence control line $E_2$ may be disposed at the right-most side of the pixels $P_{11}$ to $P_{nm}$ of the display panel 110. For example, the first and second luminescence control lines $E_1$ and $E_2$ may extend in parallel to the data lines $D_1$ to $D_m$ along opposite edges of the display panel 110.

Second connection lines $L_{2_1}$ to $L_{2_n}$ may be arranged along the row direction perpendicularly to the first and second luminescence control lines $E_1$ and $E_2$, and may be connected to the first and second luminescence control lines $E_1$ and $E_2$, e.g., each of the first and second luminescence control lines $E_1$ and $E_2$ may be connected to alternating lines of the second connection lines $L_{2_1}$ to $L_{2_n}$. The second connection lines $L_{2_1}$ to $L_{2_n}$ may be connected to the pixels arranged at corresponding rows, e.g., second connection line $L_{2_1}$ may be connected to pixels $P_{11}$ to $P_{1m}$ in the first row, second connection line $L_{2_1}$ may be connected to pixels $P_{21}$ to $P_{2m}$ in a second row, etc. Thus, the first and second luminescence control signals may be simultaneously provided to the pixels $P_{11}$ to $P_{nm}$, arranged in rows, via the second connection lines $L_{2_1}$ to $L_{2_n}$ connected to the first and second luminescence control lines $E_1$ and $E_2$. Since a luminescence control signal is provided to pixels arranged in rows, the number of second connection lines may be n (n being an integer of 1 or more), i.e., the number of rows. Therefore, a sequential scan signal and data signals may be provided to pixels, and first and second luminescence control signals may be simultaneously provided to pixels arranged in rows.

Although not shown in FIG. 3, each of the pixels $P_{11}$ to $P_{nm}$ may include sub-pixels, i.e., red, green, and blue sub-pixels. The pixels $P_{11}$ to $P_{nm}$ may be formed such that red, green, and blue sub-pixels are iteratively arranged along a row direction and the same form is iteratively arranged along a column direction. Thus, each of the data lines $D_1$ to $D_m$ may be formed of three lines connected to sub-pixels by a column unit. Three data lines connected to three sub-pixels and a scan line may be paired.

Arrangement of the pixels $P_{11}$ to $P_{nm}$ may be changed variously. For example, red, green, and blue sub-pixels may be arranged in a row direction to have a stripe structure, and different patterns may be arranged in a column direction. The pixels $P_{11}$ to $P_{nm}$ may be arranged to have a mosaic structure where they are not arranged in line in a horizontal or vertical direction. Thus, arrangement of the pixels $P_{11}$ to $P_{nm}$ may be changed variously.

Red, green, and blue sub-pixels of each pixel may be formed of an organic luminescence element (e.g., OLED), respectively. Thus, sub-pixels may emit red, green, and blue lights corresponding to currents applied to organic luminescence elements. As a result, the display panel 110 may display a specific color by combing lights of red, green, and blue sub-pixels.

For example, when the source driver unit 120 and the gate driver unit 130 are disposed at the lower part of the display panel 110, the display panel 110 may be configured as illustrated in FIG. 3. The gate driver unit 130 may be disposed at the lower part of the display panel 110 without including a shift register circuit, and the source driver unit 120 may be disposed at the lower part of the display panel 110. Thus, it is possible to reduce dead spaces of left, right, and upper sides of an organic electro luminescence display device 100.

Figure 4:
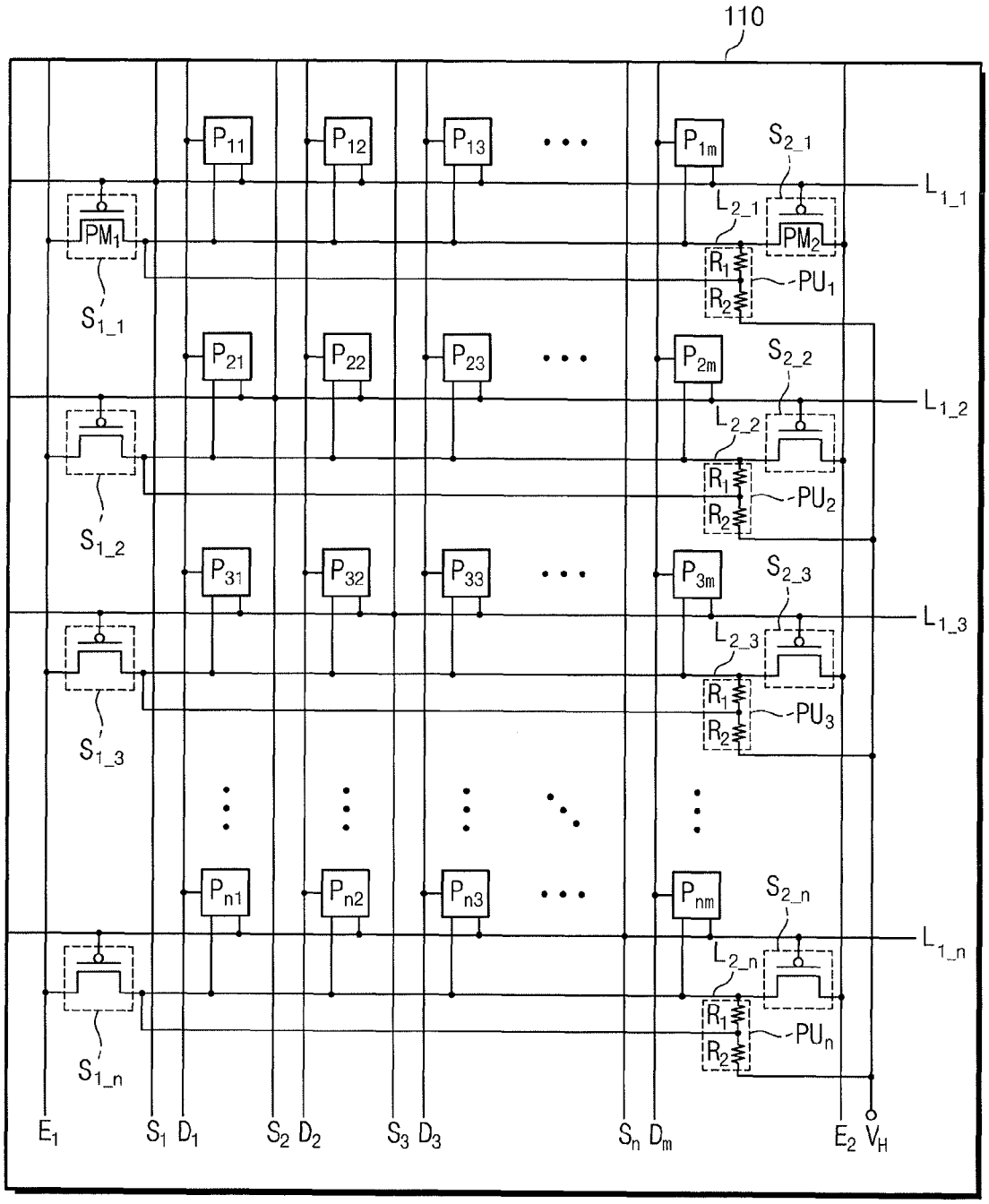
FIG. 4 is a block diagram schematically illustrating a display panel according to another embodiment of the inventive concept.

FIG. 4 is a block diagram schematically illustrating a display panel according to another embodiment of the inventive concept. Referring to FIG. 4, the display panel 110 according to another embodiment of the inventive concept may include a plurality of pixels $P_{11}$ to $P_{nm}$ arranged at intersections of m columns and n rows, first switching circuits $S_{1_1}$ to $S_{1_n}$, second switching circuits $S_{2_1}$ to $S_{2_n}$, and pull-up circuits $PU_1$ to $PU_n$.

Scan lines $S_1$ to $S_n$ may be arranged in a column direction, and first connection lines $L_{1_1}$ to $L_{1_n}$ may be arranged in a row direction perpendicular to the scan lines $S_1$ to $S_n$. The first connection lines $L_{1_1}$ to $L_{1_n}$ may be connected to corresponding scan lines $S_1$ to $S_n$, respectively. The first connection lines $L_{1_1}$ to $L_{1_n}$ may be connected to pixels $P_{11}$ to $P_{nm}$ arranged at corresponding rows. Thus, scan signals may be sequentially provided to the pixels $P_{11}$ to $P_{nm}$, arranged at corresponding rows, via the first connection lines $L_{1_1}$ to $L_{1_n}$ connected to the scan lines $S_1$ to $S_n$. Data lines $D_1$ to $D_m$ may be arranged the same as described in FIG. 3, and description thereof is thus omitted.

The first luminescence control line $E_1$ may be disposed at the left-most side of the pixels $P_{11}$ to $P_{nm}$ of the display panel 110. The second luminescence control line $E_2$ may be disposed at the right-most side of the pixels $P_{11}$ to $P_{nm}$ of the display panel 110.

Second connection lines $L_{2_1}$ to $L_{2_n}$ may be arranged in a row direction perpendicular to the first and second luminescence control lines $E_1$ and $E_2$. The second connection lines $L_{2_1}$ to $L_{2_n}$ may be connected to the pixels arranged at corresponding rows.

The first switching circuits $S_{1_1}$ to $S_{1_n}$ may be disposed at the left-most side of pixels of the display panel 110, and may connect the first luminescence control line $E_1$ with the second connection lines $L_{2_1}$ to $L_{2_n}$. The first switching circuits $S_{1_1}$ to $S_{1_n}$ may be supplied with scan signals via the first connection lines $L_{1_1}$ to $L_{1_n}$. Turn-on/off states of the first switching circuits $S_{1_1}$ to $S_{1_n}$ may be controlled by scan signals provided via the first connection lines $L_{1_1}$ to $L_{1_n}$.

The second switching circuits $S_{2_1}$ to $S_{2_n}$ may be disposed at the right-most side of pixels of the display panel 110, and may connect the second luminescence control line $E_2$ with the second connection lines $L_{2_1}$ to $L_{2_n}$. The second switching circuits $S_{2_1}$ to $S_{2_n}$ may be supplied with scan signals via the first connection lines $L_{1_1}$ to $L_{1_n}$. Turn-on/off states of the second switching circuits $S_{2_1}$ to $S_{2_n}$ may be controlled by scan signals provided via the first connection lines $L_{1_1}$ to $L_{1_n}$.

A scan signal may be an active low-level signal, and may be sequentially provided as described above. The first and second switching circuits $S_{1_1}$ to $S_{1_n}$ and $S_{2_1}$ to $S_{2_n}$ may be sequentially turned on by low-level scan signals that are provided sequentially. The second connection lines $L_{2_1}$ to $L_{2_n}$ may be sequentially connected to the first and second luminescence control lines $E_1$ and $E_2$ via the first and second switching circuits $S_{1_1}$ to $S_{1_n}$ and $S_{2_1}$ to $S_{2_n}$ that are sequentially turned on.

Thus, the first and second luminescence control signals may be sequentially provided to pixels via the second connection lines $L_{2_1}$ to $L_{2_n}$, sequentially connected to the first and second luminescence control lines $E_1$ and $E_2$, by a row unit, e.g., simultaneously to one row of pixels at a time.

Below, the first and second switching circuits $S_{1_1}$ to $S_{1_n}$ and $S_{2_1}$ to $S_{2_n}$ will be more fully described.

The first switching circuit $S_{1_1}$ to $S_{1_n}$ may include first PMOS transistors $PM_1$, and the second switching circuit $S_{2_1}$ to $S_{2_n}$ may include second PMOS transistors $PM_2$.

Sources of the first PMOS transistors PM1 of the first switching circuits $S_{1_1}$ to $S_{1_n}$ may be connected to the first luminescence control line $E_1$, and drains thereof may be connected to corresponding second connection lines $L_{2_1}$ to $L_{2_n}$, respectively. Further, the drains of the first PMOS transistors $PM_1$ of the first switching circuits $S_{1_1}$ to $S_{1_n}$ may be connected to corresponding pull-up circuits $PU_1$ to $PU_n$, and gates thereof may be connected to corresponding first connection lines $L_{1_1}$ to $L_{1_n}$.

Sources of the second PMOS transistors $PM_2$ of the second switching circuits $S_{2_1}$ to $S_{2_n}$ may be connected to the second luminescence control line $E_2$, and drains thereof may be connected to corresponding second connection lines $L_{2_1}$ to $L_{2_n}$, respectively. Further, the drains of the second PMOS transistors $PM_2$ of the second switching circuits $S_{2_1}$ to $S_{2_n}$ may be connected to corresponding pull-up circuits $PU_1$ to $PU_n$, and gates thereof may be connected to corresponding first connection lines $L_{1_1}$ to $L_{1_n}$.

With this configuration, low-level scan signals may be sequentially provided to gates of the first PMOS transistors $PM_1$ of the first switching circuits $S_{1_1}$ to $S_{1_n}$ and gates of the second PMOS transistors $PM_2$ of the second switching circuits $S_{2_1}$ to $S_{2_n}$. Thus, the first PMOS transistors $PM_1$ of the first switching circuits $S_{1_1}$ to $S_{1_n}$ and the second PMOS transistors $PM_2$ of the second switching circuits $S_{2_1}$ to $S_{2_n}$ may be sequentially turned on. This may enable the second connection lines $L_{2_1}$ to $L_{2_n}$ to be sequentially connected to the first and second luminescence control lines $E_1$ and $E_2$. As a result, the first and second luminescence control signals may be sequentially provided to pixels by a row unit.

As understood from the above description, scan signals, a first luminescence control signal, and a second luminescence control signal may be sequentially provided to pixels arranged at each row, and data signals may be provided to pixels.

The pull-up circuits $PU_1$ to $PU_n$ may be connected to the drain of the first PMOS transistors $PM_1$ of the first switching circuits $S_{1_1}$ to $S_{1_n}$ and the drain of the second PMOS transistors $PM_2$ of the second switching circuits $S_{2_1}$ to $S_{2_n}$. The pull-up circuits $PU_1$ to $PU_n$ may be connected in common to a power supply terminal $V_H$.

In detail, each of the pull-up circuits $PU_1$ to $PU_n$ may be formed of a first resistor $R_1$ and a second resistor $R_2$. In the pull-up circuit $PU_1$, the first resistor $R_1$ may have one end connected to a drain of a second PMOS transistor $PM_2$ and the other end connected to a drain of a first PMOS transistor $PM_1$. The other end of the first resistor $R_1$ may be connected to one end of the second resistor $R_2$, and the other end of the second resistor $R_2$ may be connected to the power supply terminal $V_H$. The remaining pull-up circuits $PU_2$ to $PU_n$ may be configured the same as the pull-up circuit $PU_1$.

A high-level voltage may be applied to the pull-up circuits $PU_1$ to $PU_n$ from the power supply terminal $V_H$. The first and second luminescence control signals may be an active low-level signal. In case that the first and second switching circuits $S_{1_1}$ to $S_{1_n}$ and $S_{2_1}$ to $S_{2_n}$ are turned on by a high-level scan signal, the pull-up circuits $PU_1$ to $PU_n$ may maintain the second connection lines $L_{2_1}$ to $L_{2_n}$ with a high level.

A digital circuit may have three states, that is, a high-level state, a low-level state, and a floating state. The floating state may not be a high-level state or a low-level state. That is, the floating state may be an unstable state where it is impossible to judge whether any input is received. Thus, a pull-down or pull-up circuit may enable a line to go to a low level or a high level.

In a digital circuit, a circuit connected between a signal input or output terminal and a power supply terminal to retain a logical high-level state may be referred to as a pull-up circuit (or, a pull-up resistor). Further, a circuit connected between a signal input or output terminal and a power supply terminal to retain a logical low-level state may be referred to as a pull-down circuit (or, a pull-down resistor). Thus, in case that the first and second switching circuits $S_{1_1}$ to $S_{1_n}$ and $S_{2_1}$ to $S_{2_n}$ are turned off, the pull-up circuits $PU_1$ to $PU_n$ may maintain the second connection lines $L_{2_1}$ to $L_{2_n}$ with a high level.

As illustrated in FIG. 4, the display panel 110 according to another embodiment of the inventive concept may be supplied with a scan signal being an active low-level signal and first and second luminescence control signals and utilize switching circuits formed of PMOS transistors and pull-up circuits. However, if the scan signal and the first and second luminescence control signals are an active high-level signal, the switching circuits may be formed of an NMOS transistor, respectively. Pull-down circuits may be connected in common to a ground terminal, and may maintain the second connection lines $L_{2_1}$ to $L_{2_n}$ with a low level when the first and second switching circuits $S_{1_1}$ to $S_{1_n}$ and $S_{2_1}$ to $S_{2_n}$ are turned off by a low-level scan signal. The remaining of the display panel 110 including the pull-down circuits may be configured as illustrated in FIG. 4.

Although not shown in FIG. 4, each pixel may include sub-pixels as described in FIG. 3. The sub-pixels may be arranged in the same manner as described in FIG. 3, and description thereof is thus omitted.

As the source driver unit 120 and the gate driver unit 130 are disposed at the lower part of the display panel 110, the display panel 110 may be configured as illustrated in FIG. 4. The gate driver unit 130 may be disposed at the lower part of the display panel 110 without including a shift register circuit, and the source driver unit 120 may be disposed at the lower part of the display panel 110. Thus, it is possible to reduce dead spaces of left, right, and upper sides of an organic electro luminescence display device 100.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description.

What is claimed is:

1. An organic electro luminescence display device, comprising:

a display panel including a plurality of pixels arranged at intersections of m columns and n rows;

a data driver unit configured to generate data signals and to provide the data signals to the pixels; and a gate driver unit configured to generate a first luminescence control signal, a second luminescence control signal, and scan signals, wherein the scan signals are sequentially provided to the pixels by a row unit, the first and second luminescence control signals are provided simultaneously to the pixels in a row, the first luminescence control signal is provided to the pixels via the left-most side of the pixels of the display panel, and the second luminescence control signal is provided to the pixels via the right-most side of the pixels of the display panel.

2. The organic electro luminescence display device of claim 1, wherein the display panel further comprises:

scan lines arranged in a column direction;

first connection lines arranged in a row direction perpendicular to the scan lines and connected to pixels arranged in corresponding rows;

data lines arranged in the column direction and connected to pixels arranged in corresponding columns;

a first luminescence control line arranged at the left-most side of the pixels of the display panel in the column direction;

a second luminescence control line arranged at the right-most side of the pixels of the display panel in the column direction; and second connection lines arranged in the row direction and connected to pixels arranged in corresponding rows, wherein the scan lines are connected to the first connection lines, respectively, and each of the second connection lines is connected to the first and second luminescence control lines.

3. The organic electro luminescence display device of claim 2, wherein the scan signals are configured to be sequentially provided to pixels arranged at corresponding rows via the first connection lines connected with the scan lines, the data signals are configured to be provided to the pixels via the data lines, and the first and second luminescence control signals are configured to be simultaneously provided to pixels arranged in rows via the second connection lines connected with the first and second luminescence control lines.

4. The organic electro luminescence display device of claim 3, wherein each of m and n is an integer of 1 or more, a total number of each of the scan lines, the first connection lines, and the second connection lines equals n.

5. The organic electro luminescence display device of claim 2, wherein each of the plurality of pixels includes red, green, and blue sub-pixels, the red, green, and blue sub-pixels being iteratively arranged along a row direction.

6. The organic electro luminescence display device of claim 5, wherein each of the data lines includes three lines connected to the red, green, and blue sub-pixels by a column unit.

7. The organic electro luminescence display device of claim 6, wherein each of the sub-pixels includes an organic light emitting diode.

8. The organic electro luminescence display device of claim 2, wherein the display panel further comprises:

first switching circuits arranged at the left-most side of pixels of the display panel, the first switching circuits being configured to switch the first luminescence control line and the second connection lines; and second switching circuits arranged at the right-most side of pixels of the display panel, the second switching circuits being configured to switch the second luminescence control line and the second connection lines, wherein on and off states of the first and second switching circuits are configured to be controlled by the scan signals sequentially provided via the first connection lines.

9. The organic electro luminescence display device of claim 8, wherein each of the scan signals is an active low-level signal, the first and second switching circuits being configured to sequentially turn on by the low-level scan signals that are sequentially provided.

10. The organic electro luminescence display device of claim 9, wherein the scan signals are configured to be sequentially provided to pixels arranged in corresponding rows via the first connection lines connected with the scan lines, the data signals are configured to be provided to the pixels via the data lines, and the first and second luminescence control signals are configured to be sequentially provided to pixels arranged in rows via the second connection lines sequentially connected with the first and second luminescence control lines by a row unit.

11. The organic electro luminescence display device of claim 9, wherein each of the first switching circuits includes a first PMOS transistor, and each of the second switching circuits includes a second PMOS transistor.

12. The organic electro luminescence display device of claim 11, wherein the first PMOS transistors of the first switching circuits have sources connected to the first luminescence control line, drains connected to the second connection lines, and gates connected to the first connection lines, and the second PMOS transistors of the second switching circuits have sources connected to the second luminescence control line, drains connected to the second connection lines, and gates connected to the first connection lines.

13. The organic electro luminescence display device of claim 12, further comprising pull-up circuits connected in common to a power supply terminal, the drains of the first PMOS transistors and the drains of the second PMOS transistors being connected to the pull-up circuits.

14. The organic electro luminescence display device of claim 13, wherein, when the first and second PMOS transistors are turned off by the scan signal, the pull-up circuits maintain the second connection lines with a high level.

15. The organic electro luminescence display device of claim 13, wherein each pull-up circuit includes a first resistor and a second resistor, the first resistor being connected between the drain of the second PMOS transistor and the drain of the first PMOS transistor, and the second resistor being connected between the drain of the first PMOS transistor and the power supply terminal.

16. The organic electro luminescence display device of claim 8, wherein each of the scan signals is an active high-level signal, the first and second switching circuits being configured to sequentially turn on by the high-level scan signals that are sequentially provided.

17. The organic electro luminescence display device of claim 16, wherein:

each of the first switching circuits includes a first NMOS transistor and each of the second switching circuits includes a second NMOS transistor, the first NMOS transistors of the first switching circuits have sources connected to the first luminescence control line, drains connected to the second connection lines, and gates connected to the first connection lines, and the second NMOS transistors of the second switching circuits have sources connected to the second luminescence control line, drains connected to the second connection lines, and gates connected to the first connection lines.

18. The organic electro luminescence display device of claim 17, further comprising pull-down circuits connected in common to a ground terminal, the drains of the first NMOS transistors and the drains of the second NMOS transistors being connected to the pull-down circuits.

19. The organic electro luminescence display device of claim 18, wherein, when the first and second NMOS transistors are turned off by the low-level scan signal, the pull-down circuits maintain the second connection lines with a low level.

20. An organic electro luminescence display device, comprising:

a display panel including a plurality of pixels arranged at intersections of a plurality of rows and a plurality of columns;

a first film including a plurality of via holes;

a second film attached at a lower part of the first film;

a source driver unit attached at an upper part of the first film;

a gate driver unit attached at a lower part of the second film;

data lines connected to the source driver unit and to pixels arranged in corresponding columns via the via holes in the first film;

scan lines connected to the gate driver unit, the scan lines passing through the via holes of the first film to be connected to pixels arranged in rows via the first film; and first and second luminescence control lines connected to the gate driver unit, the first and second luminescence control lines passing through the via holes of the first film to be connected to pixels via the first film, the first luminescence control line being disposed at a left-most side of pixels of the display panel, and the second luminescence control line being disposed at a right-most side of pixels of the display panel.

21. The organic electro luminescence display device of claim 20, wherein the data driver unit is configured to generate data signals to be provided to the pixels via the data lines, and the gate driver unit is configured to generate a first luminescence control signal to be provided to the pixels via the first luminescence control line, a second luminescence control signal to be provided to the pixels via the second luminescence control line, and scan signals to be provided to the pixels via the scan lines.

* * * * *